US006296453B1

(12) United States Patent
Layman

(10) Patent No.: US 6,296,453 B1
(45) Date of Patent: Oct. 2, 2001

(54) PRODUCTION BOOSTER IN A FLOW LINE CHOKE

(76) Inventor: James Layman, 8419 E. Sherri Cir., Manvel, TX (US) 77578

( * ) Notice: Subject to any disclaimer, the term of this patent is extended or adjusted under 35 U.S.C. 154(b) by 0 days.

(21) Appl. No.: 09/379,080

(22) Filed: Aug. 23, 1999

(51) Int. Cl.[7] ..... F04F 5/00

(52) U.S. Cl. ..... 417/151; 137/375

(58) Field of Search ..... 166/320, 53, 261, 166/372, 302, 310; 137/625.3, 155, 219, 895, 599, 375; 417/54, 53, 151; 451/40

(56) References Cited

U.S. PATENT DOCUMENTS

| | | | | |
|---|---|---|---|---|
| 3,552,490 | * | 1/1971 | Dollison | 166/320 |
| 3,683,965 | * | 8/1972 | McClure et al. | 137/625.3 |
| 3,834,414 | * | 9/1974 | McMurry | 137/155 |
| 4,025,235 | * | 5/1977 | Newbrough | 417/54 |
| 4,106,562 | | 8/1978 | Barnes et al. | 166/97 |
| 4,390,061 | * | 6/1983 | Short | 166/53 |
| 4,555,872 | * | 12/1985 | Yie | 451/40 |
| 4,557,329 | * | 12/1985 | Savard et al. | 166/261 |
| 4,618,314 | * | 10/1986 | Halley | 417/53 |
| 4,712,579 | | 12/1987 | Wolcott et al. | 137/375 |
| 4,716,970 | * | 1/1988 | Henning | 166/372 |
| 4,825,895 | * | 5/1989 | Maltman | 137/219 |
| 4,988,389 | * | 1/1991 | Adamache et al. | 166/302 |
| 5,105,889 | * | 4/1992 | Misikov et al. | 166/372 |
| 5,246,074 | * | 9/1993 | Ayres | 166/310 |
| 5,427,151 | * | 6/1995 | Pauley | 137/895 |
| 5,485,867 | * | 1/1996 | Stoll | 137/599 |
| 5,752,570 | * | 5/1998 | Shaposhnikov et al. | 166/372 |

OTHER PUBLICATIONS

Printout of Internet Web Site for Thornhill Craver Adjustable Chokes: www.camerondiv.com.
Printout of Internet Web Site for Cameron Willis Choke Products: www.camerondiv.com.

* cited by examiner

*Primary Examiner*—Teresa Walberg
*Assistant Examiner*—Leonid Fastovsky
(74) *Attorney, Agent, or Firm*—Bracewell & Patterson, L.L.P.

(57) ABSTRACT

A flow line choke includes a venturi to draw a vacuum in the choke body. This vacuum creates a pressure differential between the producing strata below and the choke body, thereby increasing flow of fluid from the well. A gas recirculation line from the outlet of the choke, through a compressor, back to the choke, provides a source of pressurized gas through a bore in an injector stem to create flow through the venturi.

16 Claims, 3 Drawing Sheets

PRODUCTION BOOSTER IN A FLOW LINE CHOKE

FIELD OF THE INVENTION

The present invention relates generally to the field oil and gas production equipment and, more particularly, to a flow line choke that increases production from a low pressure well.

BACKGROUND OF THE INVENTION

Chokes, i.e., fluid flow regulating devices, are used in flow lines leading from wells such as oil and/or gas wells in the earth. Some of these well flow line chokes are positive chokes (fixed flow) and others are adjustable (variable flow rate). A variable flow rate choke has a movable means for varying the amount of restriction on well fluids flowing through the choke. Normally, the movable means in the choke body is designed to mate with an insert which is fixed in the body of the choke to cause the restricting effect on the fluids. This insert acts like a valve seat, and the solid valve stem may be moved axially for greater or lesser choking of the fluid flow. Such a well flow line choke is well described in Wolcott et al., U.S. Pat. No. 4,712,579.

A number of effective and successful flow line chokes are commercially available, notably from Cameron Willis, Best, OCT, Grayloc, Thornhill-Craver, Master-Flo, and BST Lift Systems. These chokes do an excellent job of regulating the flow of oil and gas from the wellhead, controlling the rate of production and the rate of introduction of hydrocarbons into the sales stream. However, as the well becomes depleted, wellhead pressure drops, and eventually no flow regulation is required since the well operates full open and may even require a compressor to introduce the hydrocarbons into the sales stream. None of the chokes known heretofore can enhance the flow of oil and gas through the fluid flow line as the well becomes depleted and wellhead pressure decreases to a low pressure.

Thus, there remains a need for a well flow line choke which can enhance oil and gas recovery from a well at low wellhead pressure.

SUMMARY OF THE INVENTION

The present invention addresses these and other drawbacks in the art by providing a venturi in the choke to draw a vacuum in the choke body. This vacuum creates a pressure differential between the producing strata below and the choke body, thereby increasing flow of fluid from the well.

In one aspect, the present invention provides a gas recirculation line from the outlet of the choke, through a compressor, back to the choke. The compressor provides gas flow through a venturi to create the vacuum. Gas flow through the venturi may also be provided from another source of pressurized gas.

In another aspect of this invention, there is provided a modified fluid flow choke with a flow line through the choke stem. The flow line through the stem is injected with pressurized and recirculated gas from the outlet of the choke. The region within the body between an insert, serving as a valve seat, and a conical region of the stem, serving as a valve disk, acts as a venturi to create an ideal vacuum at the venturi, preferably about 30", and thereby in the choke body.

The present invention provides a number of advantages over the flow restricting chokes of the art. For example, the production booster of this invention alleviates flaring from the well, thereby reducing pollution. Gas, which otherwise would be flared, is instead compressed and recirculated into the choke of this invention. There, the compressed gas is injected onto a choke beam, creating a venturi effect and drawing fluid from the well to increase productivity and increase the useful life of the well. In another aspect of this invention, if higher tubing well pressure is available and accessible, this higher tubing pressure can be jumped off to inject through the choke of this invention, thereby keeping a marginal well flowing, and increasing it's production until the well is depleted. A further advantage of this invention is the reduction in time required to return a well to normal flowing rate after a shut in. Finally, by recirculating and using gas that would otherwise be flared, the total recovery from a well is increased.

The present invention is easily adapted to any of the currently commercially available well flow line chokes. This provides the advantage of inexpensive retrofit of operating installations as wellhead pressure drops to commercially unviable levels. Further, the compressor does not require an expensive overhaul and modification to maintain the well in operation.

These and other aspects, features, and advantages of the present invention will be apparent to those skilled in the art from a review of the following description.

DETAILED DESCRIPTION OF A PREFERRED EMBODIMENT

Figure 1:
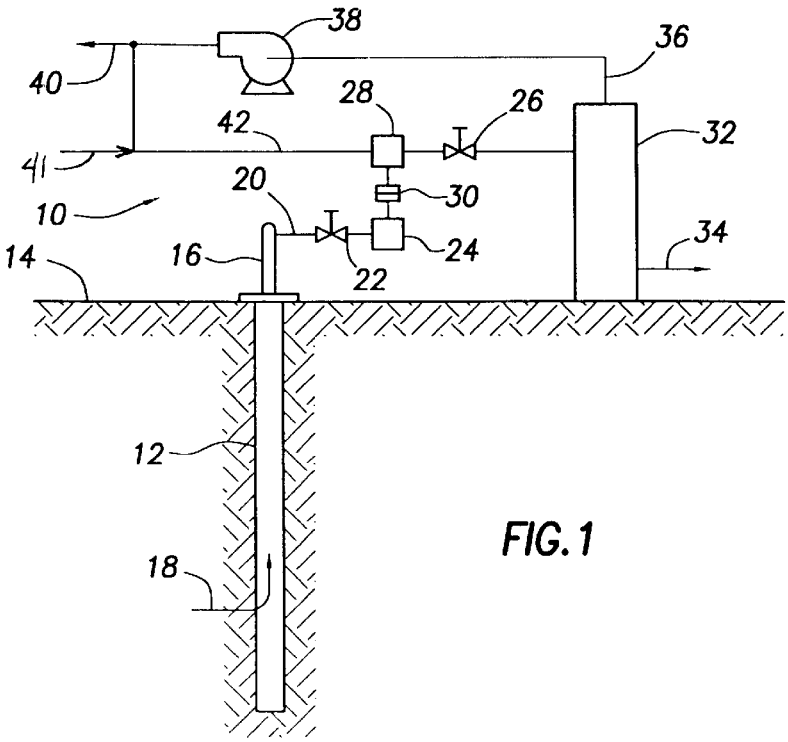
FIG. 1 is a schematic diagram of a well and a separating system which includes a recirculation system and modified choke of this invention.

As shown in FIG. 1, a wellhead system 10 of this invention is applied to a producing well 12 into the earth 14. The producing well 12 is capped with a conventional wellhead 16, which is well known in the art. The wellhead 16 receives fluids 18, such as oil and/or gas produced from the earth into the well 12. The fluids 18 pass into a flow line 20 to a conventional cut-off valve 22 and into a well flow line choke 24 of conventional design. The cut-off valve 22, and a cut-off valve 26, provide for complete isolation of their respective segments of the wellhead system 10. The flow of fluids from the wellhead is regulated to any desired extent by adjustment of the choke 24 so long as the wellhead pressure remains adequate, for example down to 100–200 psi.

The choke 24 is joined to a choke 28 of this invention through a flanged connection 30. It will be understood by those skilled in the art that each of the individual components of the system 10 are coupled into the system by flanges for easier assembly and maintenance of the individual components. As described below in greater detail with regard to FIG. 2, the choke 28 includes a venturi to create a vacuum in the body of the choke 28, to increase fluid flow at low wellhead pressure.

Fluids from the choke 28 flow through the isolation valve 26 into a separator 32, which separates the liquid components from the gaseous components. The liquid components are drawn off through a liquid flow line 34 and the gaseous components are drawn off through a gas flow line 36. The gas flow line 36 passes to the suction of a compressor 38, which raises the gas pressure enough to pass at a regulated rate into a sales line 40. The discharge of the compressor 38 is also recirculated into an inlet line 42 of the choke 28, in accordance with this invention. Pressurized gas may also be provided from an external source (not shown) through a input line 41 to create the gas flow in the choke.

Figure 2:
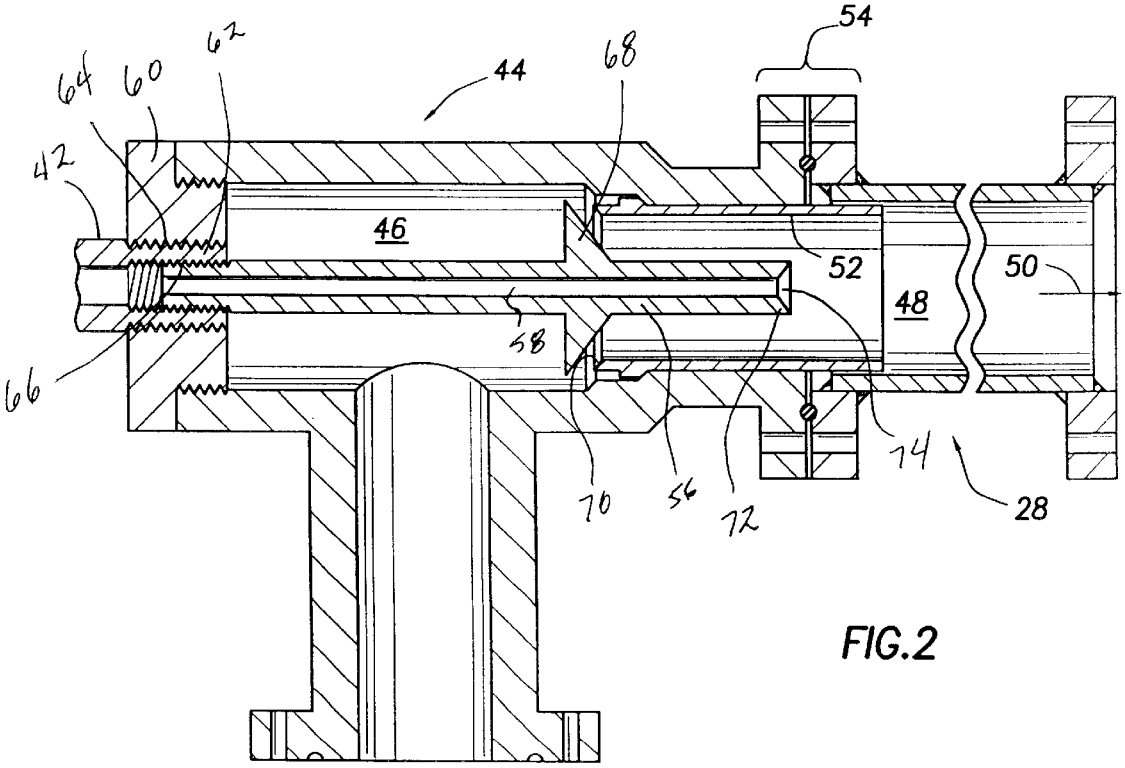
FIG. 2 is a section view of a choke and valve of this invention with the choke stem in a fixed position.

FIG. 2 depicts an enlarged cross section of one embodiment of the choke 28 of this invention. The choke 28 comprises a body 44 which has a body chamber 46 within the body. The choke 28 also includes an outlet bore 48 for connecting to the system 10 downstream of the choke, as indicated by the arrow 50. Between the body chamber 46 and the outlet bore 48 is an insert 52, which traverses a flange 54.

Inside the body chamber 46 and extending into the insert 5 2 is an elongate injection member 56. The injection member 5 6 includes a longitudinal bore 58 which extends the length of the member 56. The bore is provided with pressurized recirculated gas from the recirculation line 42, which couples to the choke body with a cap 60. The recirculation line 42 terminates with a nipple 62, which includes exterior threads 64 and interior threads 66. The injection member 56 includes exterior threads which mate with the interior threads 66 of the nipple 62.

The injection member further includes a conical disk 68 which is positioned at a selected distance from a seat 70. The region between the disk 68 and the seat 70 forms a venturi, as described below. The injection member 56 terminates in a distal end 72, which includes a flared outlet nozzle 74. I have found that an angle of 7° as measured from the horizontal, provides greater flow for creating the venturi effect than a greater angle, such as 45°.

In operation, pressurized and recirculated gas is provided through the line 42 into the longitudinal bore 58. Pressurized as may also be provided from the input line 41. The gas accelerates as it expands from the outlet nozzle 74. The gas exiting the outlet nozzle 74 entrains gas extant in the insert, which draws gas through the venturi between the disk 68 and seat 70. This gas flow creates a pressure drop in the chamber 46. Lower pressure in the chamber thus develops a pressure differential with the well 12, and draws fluids from the producing strata.

The injection member 56 is fixed relative to the choke body 44 in the embodiment of FIG. 2. In some circumstances and applications, operators may desire an adjustable stem. Such an embodiment is provided in FIG. 3.

Fluids, in the form of oil and/or gas, are introduced into the choke through an input line 80. The fluids pass into the choke body 44 at the chamber 46. Extending from the chamber 46 is the insert 52. A beveled end 82 of the insert 52 functions as a seat, like the seat 70 of FIG. 2. A conical face 84 of a choke stem 86 acts as a valve disk, and the region between the face beveled end 82 and conical face 84 defines a venturi, as previously described.

The distal end 72 of the choke stem 86 extends into the insert 52, and defines a nozzle 74 for the discharge of pressurized gas.

Figure 3:
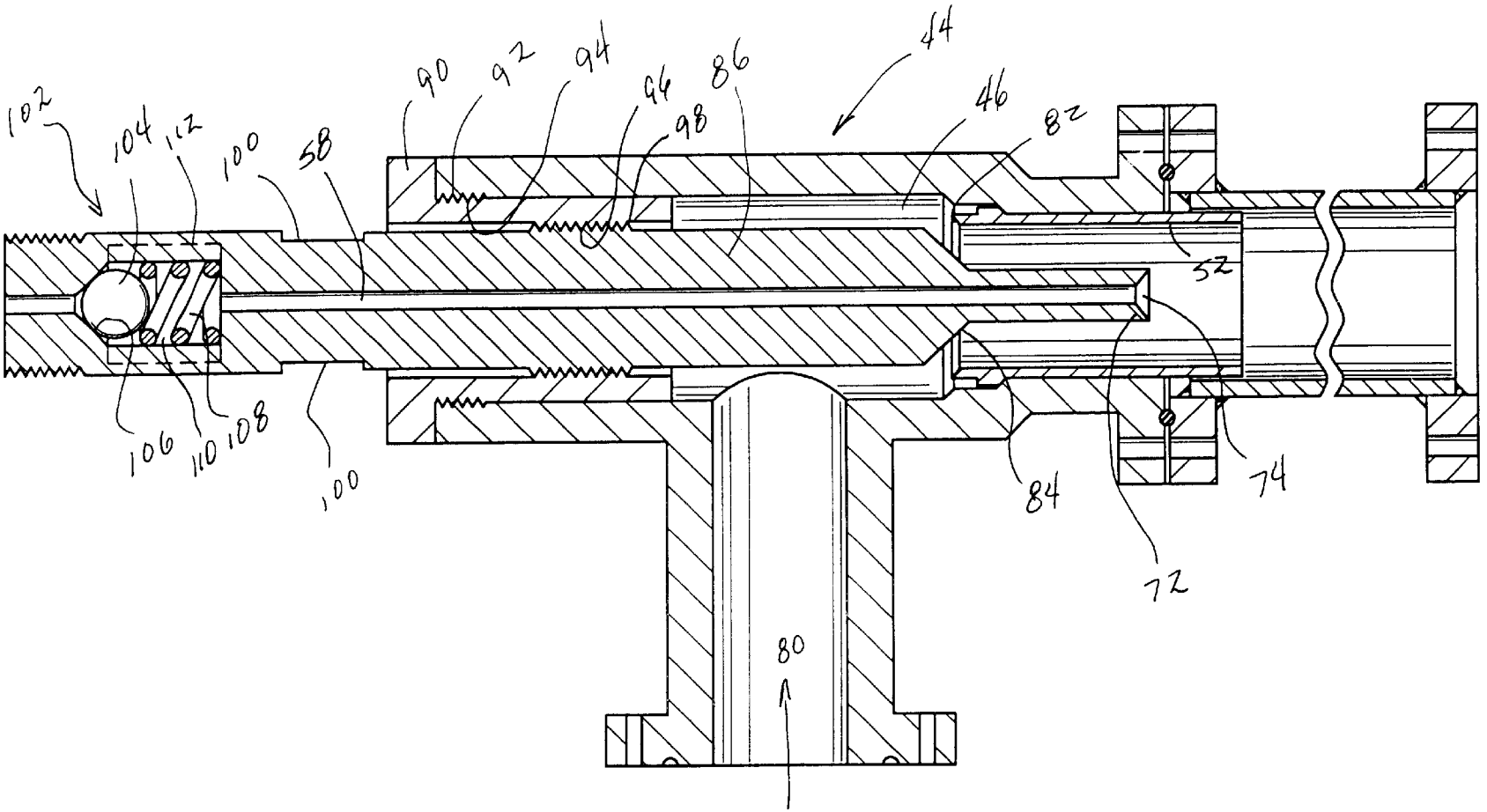
FIG. 3 is a section view of a choke and valve with an adjustable stem.

The structure of the variable choke of FIG. 3 differs from that of FIG. 2 in that rather than a cap, the choke body is enclosed by a threaded insert 90. The insert 90 includes exterior threads 92 which engage interior threads 94 on the body 44. The insert 90 further includes a set of interior threads 96 which engage exterior threads 98 on the stem 86. The insert 90 is screwed down into the body 44 by screwing the threads 92 into engagement with the threads 94 to the fullest extent. The threads 96 and 98 are engaged to the extent desired to adjust the clearance between the seat 82 and disk 84, to create the vacuum in the chamber 46 desired.

The stem 86 is also provided with handle engagement flats 100, where a handle or hand wheel or other manual engagement means may be applied.

The bore 58 is further provided with a check valve 102. The check valve 102 comprises a ball 104 which seats against a check valve seat 106 under the influence of a biasing means such as a spring 108. The spring 108 is positioned in a chamber 110, and retains the ball 104 against the seat 106. The chamber 110 is provided with a plurality of grooved channels 112 to enhance gas flow through the chamber 110 when the check valve is open. This check valve arrangement prevents back flow from the chamber 46 back into the recirculation system of this invention.

Figure 4:
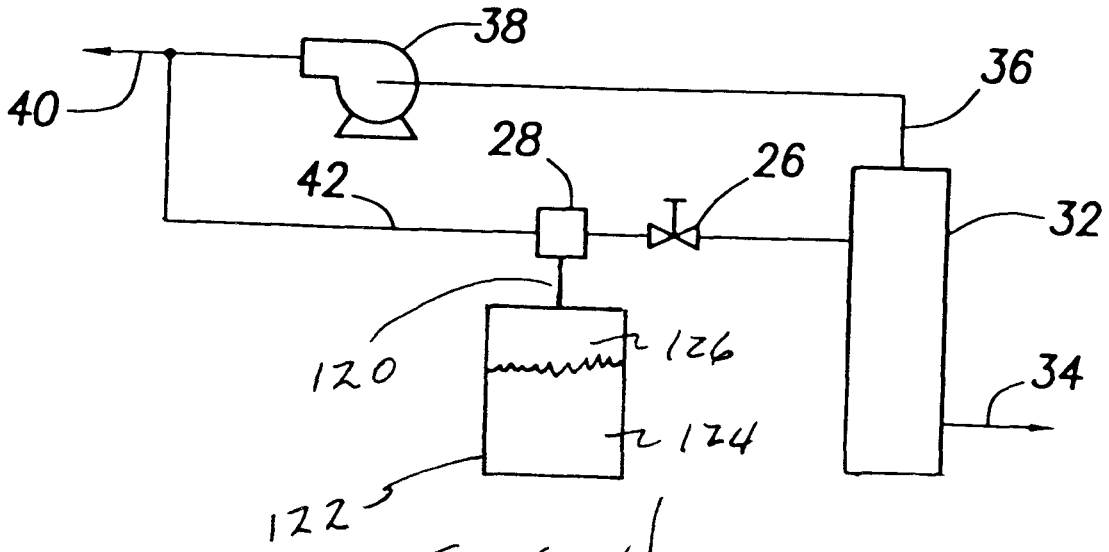
FIG. 4 is a schematic diagram of a vapor recovery system from a storage facility using the present invention.

FIG. 4 illustrates that the choke of this invention may find application in vapor recovery aside from a well flow line. In FIG. 4, the same elements are numbered in the same fashion. In this case, an inlet line 120 of the choke 28 is coupled to a storage tank 122, for example. The storage tank has stored therein a quantity of a hydrocarbon liquid 124, and a vapor space 126 above the liquid. In this case, the choke works in exactly the same way as previously described. The compressor 38 provides pressurized gas on the line 42 which is coupled to the bore of the stem within the choke. The pressurized gas, in flowing through the choke, creates a vacuum in the venturi within the choke, thus drawing vapor from the vapor space 126, which is then recovered. Note also that the pressure inlet line 41 is not included in the structure depicted.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A choke comprising:

a. a choke body having a flow line inlet and an outlet;

b. a first chamber in the choke body in fluid communication with the flow line inlet and a second chamber within the choke body in fluid communication with the outlet;

c. an elongate injector within the body between the inlet and the outlet, the injector having an axial bore therethrough and defining a distal end within the choke body and extending into the second chamber, the bore adapted to carry pressurized gas; and d. a venturi between the choke body and the injector.

2. The choke of claim 1, further comprising an insert in the body proximate the distal end of the injector.

3. The choke of claim 2, further comprising a. a conical disk on the injector;

b. a seat on the insert; and c. wherein venturi is between the disk and the seat.

4. The choke of claim 1, wherein the distal end of the injector forms an outlet nozzle.

5. The choke of claim 1, wherein the flow line inlet is adapted to be coupled to a well flow line.

6. The choke of claim 1, wherein the source of pressurized gas is a hydrocarbon vapor source.

7. A well flow line choke system comprising:

a. a well flow line choke, the choke comprising i. a choke body having a flow line inlet and an outlet;

ii a first chamber in the choke body in fluid communication with the flow line inlet and a second chamber within the choke body in fluid communication with the outlet;

iii. an elongate injector within the body between the inlet and the outlet, the injector having an axial bore therethrough and defining a distal end within the choke body and extending into the second chamber, the bore adapted to carry pressurized gas; and iv. a venturi between the choke body and the injector; and b. a source of gas pressure coupled to the bore.

8. The system of claim 7, wherein the source of gas pressure comprises a compressor whose suction is coupled to the choke body outlet and whose discharge is coupled to the bore.

9. The system of claim 7, further comprising an insert in the body proximate the distal end of the injector.

10. The choke of claim 9, further comprising a. a conical disk on the injector;

b. a seat on the insert; and c. wherein venturi is between the disk and the seat.

11. The system of claim 7, wherein the distal end of the injector forms an outlet nozzle.

12. A well flow line choke comprising:

a. a choke body having a flow line inlet and an outlet;

b. a first chamber in the choke body in fluid communication with the flow line inlet and a second chamber within the choke body in fluid communication with the outlet;

c. an elongate injector within the body between the inlet and the outlet, the injector having an axial bore therethrough and defining a distal end within the choke body and extending into the second chamber, the bore adapted to carry pressurized gas;

d. a venturi defining a clearance region between the choke body and the injector; and e. a variable coupling between the choke body and the injector, the coupling providing a means for varying the clearance region of the venturi.

13. The choke of claim 12, further comprising an insert in the body proximate the distal end of the injector.

14. The choke of claim 12, wherein the distal end of the injector forms an outlet nozzle.

15. The choke of claim 12, further comprising a check valve in the bore.

16. The choke of claim 12, further comprising means for coupling a manual adjustment means to the injector.

* * * * *